United States Patent [19]

Bumpus et al.

[11] Patent Number: 4,490,957

[45] Date of Patent: Jan. 1, 1985

[54] SUSPENDED CEILING STRUCTURES

[75] Inventors: Boyd B. Bumpus, Redondo Beach; Alex Rosenblatt, Beverly Hills; Leonard Rosenblatt, Pacific Palisades, all of Calif.

[73] Assignee: Globe Illumination, Gardena, Calif.

[21] Appl. No.: 513,923

[22] Filed: Jul. 14, 1983

Related U.S. Application Data

[63] Continuation of Ser. No. 271,646, Jun. 8, 1981.

[51] Int. Cl.[3] ..... E04B 5/52

[52] U.S. Cl. ..... 52/489; 52/476

[58] Field of Search ..... 52/482, 489, 484, 474, 52/475, 476, 498, 455, 494, 624, 656, 710

[56] References Cited

U.S. PATENT DOCUMENTS 3,210,716 10/1965 Meacham ..... 52/710 X 3,383,811 5/1968 Ades ..... 52/28

*Primary Examiner*—Carl D. Friedman

*Attorney, Agent, or Firm*—Edward D. O'Brian; K. H. Boswell

[57] ABSTRACT

A frame for concealing the lower surfaces of T-bars surrounding an opening in a suspended ceiling utilizing inverted T-bars can be constructed so as to include tracks on at least one side of the frame and movable clips movably mounted on the tracks. These clips are shaped so as to be capable of fitting around the edges of the T-bars and engaging the upper surfaces of the T-bars in supporting the frame. At least the noted one side of the frame is sufficiently resilient so as to permit this side of the frame to be temporarily deformed in installing the frame so that the clips are hooked over a T-bar.

2 Claims, 3 Drawing Figures

SUSPENDED CEILING STRUCTURES

This application is a continuation, of application Ser. No. 271,646, filed June 8, 1981.

BACKGROUND OF THE INVENTION

The invention set forth in this specification pertains to new and improved suspended ceilings.

At the present time, it is common place to utilize suspended ceiling structures which include a grid of inverted T-shaped bars located so as to be joined together to define a plurality of openings located immediately adjacent to one another in a rectilinear pattern. The T-bars used in such a ceiling structure are normally of an identical construction. Each of them normally includes a cross bar more or less corresponding to the head on the letter T, which as used in a suspended ceiling, provides a single lower surface and two upper surfaces separated by a base member reasonably corresponding to the vertical upright in the conventional letter T. In such a ceiling, the base member extends upwardly from between the two upper surfaces present. In such a ceiling, the upper surfaces on these T-bars are located at the adjacent edges of the openings defined by the bars.

In this type of suspended ceiling structure many of the openings are normally closed off by means of panels or so-called tiles. Each of these panels is normally shaped so as to be capable of resting on the upper surfaces surrounding an opening in order to close off the opening. Other of the openings in such a ceiling are normally closed off by illumination fixtures which are also shaped so as to be capable of resting against the upper surfaces of the T-bars surrounding such openings. Still further openings in such a ceiling may be used for other purposes such as, for example, in accommodating various vents used for air conditioning or heating purposes. Such vents may or may not be constructed so as to be supported by the T-bars surrounding openings in the manner in which panels and illumination fixtures are normally supported in the type of ceiling structure described.

While ceiling structures as indicated in the preceding paragraphs are very desirable and utilitarian, they are not always acceptable to many designers and decorators. Such individuals feel that in many cases the appearances of rooms can be improved by covering the T-bars used in the ceiling structure. To this end, various panels or tiles have been developed which are shaped so as to include peripheral grooves or similar or related structures located around portions of T-bars so as to suspend such panels or tiles so that the lower surfaces of such panels or tiles are beneath the T-bars and obscure the lower surfaces of such T-bars.

Unfortunately, panels or tiles of this type only obscure portions of the lower surfaces of the T-bars at any particular one spot or location. As a result of this, the lower surfaces of the T-bars surrounding a particular opening enclosed by an illumination fixture will be visible in the absence of some specialized structure obscuring the part of the lower surface of the T-bar immediately surrounding a supported illumination fixture.

A problem has been encountered in obscuring such portions of the lower surfaces of T-bar ceilings immediately surrounding openings covered by illumination fixtures. This is the problem of how to construct an appropriate frame for this purpose in such a manner that the means for suspending the frame are not readily visible and in such a manner that the frame may be easily and conveniently installed or demounted as required.

SUMMARY OF THE INVENTION

Broadly, the present invention is intended to fulfill the need indicated in the preceding discussion. It is intended to provide suspended ceilings as indicated in the preceding discussion in which a frame is used so as to obscure the portions of the lower surfaces of a T-bar surrounding an opening enclosed by a lighting fixture so that immediately adjacent to the lighting fixture the frame appears essentially as a continuation of the lower surfaces of panels or tiles mounted adjacent to the lighting fixture.

The invention contemplates the use of relatively inexpensive, easily manufactured frames and clips in a suspended ceiling structure as described. The invention is also concerned with frames and clips as indicated which may be easily and conveniently installed in or removed from a ceiling and which are of such a character that they appear essentially as a continuation of the lower surfaces of panels or tiles extending beneath the T-bars in a ceiling.

In accordance with the present invention these objectives are achieved by providing a suspended ceiling structure as indicated in the preceding which has a grid of inverted T-shaped bars defining a plurality of openings located in a rectilinear pattern. Various of these openings are enclosed and covered by panels having lower surfaces extending beneath the lower surfaces of the T-bars. A particular one of these openings is enclosed and covered by an illumination fixture resting on the upper surfaces of the T-bars surrounding this particular opening.

In a ceiling structure of the present invention the periphery of this particular opening is obscured by a frame including opposed sides shaped so as to include tracks carrying clips or clip means. Each clip means used is shaped so as to be capable of fitting around the T-bar immediately adjacent to the particular opening so as to suspend the frame in such a manner as to obscure the view of the lower surface of the T-bar immediately adjacent to this particular opening.

BRIEF DESCRIPTION OF THE DRAWING

Because of the nature of this invention, it is best more fully explained with reference to the accompanying drawing in which.

Figure 1:
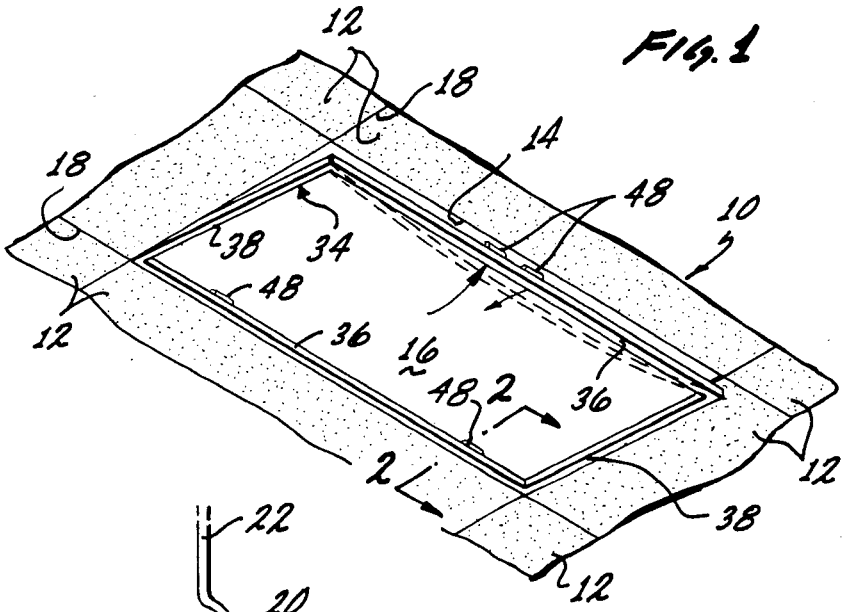
FIG. 1 is a perspective view showing a part of a suspended ceiling structure in accordance with this invention as this structure is in the process of being finished by the installation of a frame.

The particular suspended ceiling structure illustrated in the drawing is considered to be a preferred structure in accordance with the concepts of this invention as set forth in the appended claims. It will be realized that the accompanying drawing does not purport to show any precise construction drawn to scale but is intended to illustrate the nature of a structure employing the concepts of the invention as verbally expressed in the appended claims. These concepts may be employed in various differently appearing and frequently somewhat differently constructed structures through the use or exercise of routine engineering skill.

DETAILED DESCRIPTION

In the drawing there is shown a suspended ceiling structure 10 of the present invention which as normally viewed from within the interior of a room includes a ceiling of panels or tiles 12 wholly or partially surrounding a particular opening 14 enclosed by a conventional illumination fixture 16. This particular opening 14 and various other openings 18 enclosed by the panels 12 are defined by a series of inverted T-shaped bars 20 located in a rectangular pattern relative to one another so as to appear essentially as a grid (not numbered). The bars 20 are normally suspended from the actual ceiling in a room through the use of wires 22.

Each of the T-bars 20 includes a flat lower surface 24 formed on a cross bar 26 which is attached to a vertically extending base member 28. Upper surfaces 30 are located on the cross bars 26 on opposite sides of the base member 28. The wires 22 are attached to this base member 28 as shown or in other equivalent manners. It is noted that the panels 12 include peripheral grooves 32 which fit generally over portions of the base members 28 so as to be supported on upper surfaces 30 and so as to extend to cover approximately one-half of the adjacent lower surfaces 24.

With the present invention those portions of the lower surfaces 24 which are not obscured by the panels 12 are covered by a frame 34. This frame 34 includes sides 36 and ends 38 of identical cross sectional configuration and of a resilient, self-supporting material such as aluminum. The ends 38 and sides 36 are joined together in a conventional manner utilizing flat corner brackets 40 secured in place within parallel, aligned internal grooves 42 through the use of conventional self-tapping screws 44 or the like. These grooves 42 are separated by an internal space 46 which is open generally at the top (not separately numbered) of the frame 34.

Figure 2:
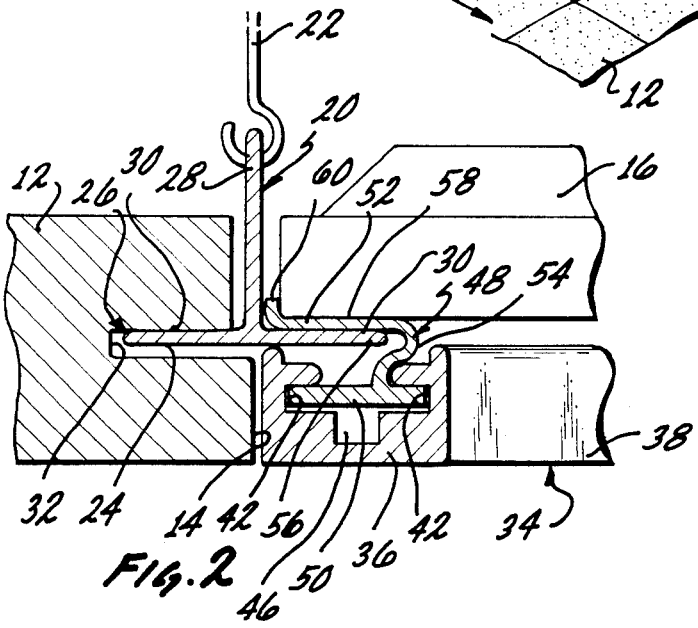
FIG. 2 is a partial cross-sectional view in an enlarged scale taken at line 2—2 of FIG. 1.
Figure 3:
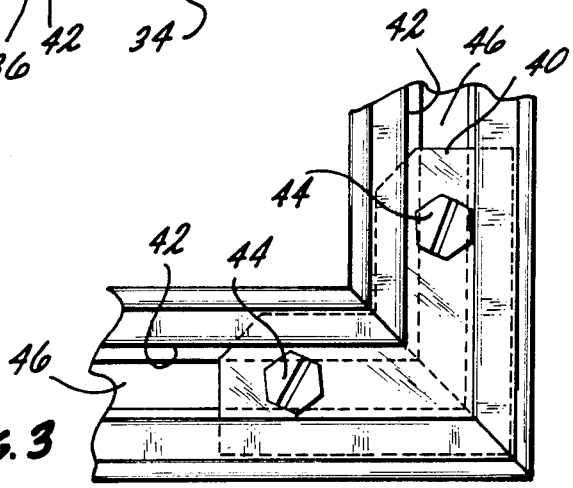
FIG. 3 is a rear elevational view in an enlarged scale of a corner of the rear of a frame as indicated in the preceding figures.

Two separate, identical self-supporting clips 48 are preferably located in each of the sides 36. These clips 48 include bottom plates 50 located within the groove 42. These grooves 42 serve as track means enabling the clips 48 to be moved in a lineal manner within them. Each of the clips 48 also includes a hook element 52 shaped as shown in FIG. 2 so as to include a curved section 54 extending generally around the edge 56 of a cross bar 26, a flat horizontally extending section 58 and a small upstanding terminal lip 60. These hook elements 52 are shaped in such a manner that when engaged with respect to the T-bar 20 as shown in FIG. 2 the frame 34 may be pivoted slightly from a position at an angle of roughly 20°–30° to the horizontal to a completely horizontal position.

In assembling the frame 30 the two clips 48 along one of the sides 36 are spread apart and are inserted so that the hook elements 52 on them engage the cross bar 26 of a T-bar 20 as shown until such time as the lips 60 are generally along the exterior (not numbered) of the fixture 16 immediately adjacent to the base member 28 of the particular T-bar 20. At this point, the frame 30 will normally hang downwardly from the remainder of the ceiling 10 by an angle of roughly 20°–30° as indicated in the preceding. Next, the two clips 48 on the other of the sides 36 will be pulled generally adjacent to one another and this particular side 36 will be bowed as indicated by the dotted lines in FIG. 1 to a sufficient extent so as to permit these two clips 48 to be positioned generally in the manner of the other clips in the frame 34. After this has occurred, the side 36 is released and the two adjacent clips 48 will be spread apart so that the frame 34 is supported at a number of points.

At this time, the ceiling 10 is completed with the frame 34 appearing more or less as an extension of the panels 12 surrounding the opening 14. This frame 34 thus serves to "complete" the ceiling 10 in such a manner that no portions of the T-bars 20 are normally visible. When it is necessary to gain access to the fixture 16 for any reason, the frame 34 may be easily removed from the opening 14 by reversing the sequence of operations indicated in the preceding.

I claim:

1. In a suspended ceiling structure having a grid of inverted T-shaped bars defining a plurality of openings located immediately adjacent to one another in a rectilinear pattern, each of said T-bars including a cross bar presenting a single lower surface and two upper surfaces and a base member extending upwardly from between said upper surfaces, said upper surfaces of said bars being located at the edges of said openings, an object located so as to cover a particular one of said openings, said object being supported on the upper surfaces of the T-bars surrounding said particular opening, in which the improvement comprises:

a rectilinear frame for concealing the lower surfaces of the T-bars surrounding said particular opening, said frame being dimensioned so as to have an upper surface located opposite and adjacent to the exposed portions of the lower surfaces of said T-bars surrounding said particular opening, said rectilinear frame including two opposed sides of uniform cross-sectional configuration shaped so as to each include track means capable of being utilized in suspending said frame, clip means carried by said track means at each of said sides, said clip means being only movable linearly along the lengths of said track means at said sides so as to facilitate assembly of said frame on said T-bars surrounding said particular opening, said clip means inserted beneath said object along the upper surfaces of said T-bars surrounding said particular opening for the purpose of supporting said frame, said clip means being shaped so as to permit said frame being inserted generally within said particular opening and at an angle relative to the T-bars surrounding said particular opening so that the clip means at one of said sides are supported by the upper surface of an adjacent T-bar and so as to permit said frame thereafter to be pivoted into a final position, at least the side of said frame opposite said one of said sides being sufficiently resilient so as to permit temporary deformation of said frame so that the clip means on the opposite of said sides can be inserted so as to be supported on the upper surface of an adjacent T-bar, said track means on each of said sides includes two parallel, aligned grooves suspended by an internal space, said space being open at the top of said frame, said grooves and said space being located internally of said frame, the space between said grooves being open at the top of said frame, each of said clip means includes a bottom plate fitting within aligned grooves and a hook element extending upwardly from said frame, said hook elements on said clip means being shaped so as to hold said sides of said frame closely adjacent to and beneath said T-bars.

2. A suspended ceiling structure as claimed in claim 1 wherein:

there are two of said clip means located at each of said sides of said frame, said clip means being capable of being moved along the lengths of the sides where they are located so as to permit two of said clip means at one of said sides being positioned adjacent to one another as said frame is installed in a ceiling, said clip means being capable of being moved on said sides so as to be spaced from one another in order to support said frame at the various points along the lengths of said sides.

* * * * *